US005660162A

United States Patent [19]

Eavenson et al.

[11] Patent Number: 5,660,162

[45] Date of Patent: Aug. 26, 1997

[54] ARTIFICIAL LOG ASSEMBLY

[75] Inventors: Barry Eavenson, Asheville; James S. Rice, Marshall, both of N.C.

[73] Assignee: Appalachian Stove & Fabricators, Inc., Asheville, N.C.

[21] Appl. No.: 396,666

[22] Filed: Mar. 1, 1995

[51] Int. Cl.[6] ..... F24C 3/00

[52] U.S. Cl. ..... 126/512; 431/125

[58] Field of Search ..... 126/512; 431/283, 431/278, 125

[56] References Cited

U.S. PATENT DOCUMENTS

| | | | |
|---|---|---|---|
| 973,498 | 10/1910 | Geurink | 431/278 |
| 1,073,321 | 9/1913 | Boeck | 431/283 |
| 1,404,783 | 1/1922 | McKee | 431/283 |
| 1,972,016 | 8/1934 | Horton | 431/283 |
| 2,011,097 | 8/1935 | Wantz | 431/278 |
| 2,072,552 | 3/1937 | Gauger | 431/283 |
| 5,069,200 | 12/1991 | Thow et al. | 431/125 |

*Primary Examiner*—Carl D. Price
*Attorney, Agent, or Firm*—Carter & Schnedler

[57] ABSTRACT

There is provided an improved artificial log assembly having a primary burner and a neat gas burner and having a first log which is preferably split into two members. The primary burner is located in front of the first log to heat the first log to its glow temperature. The major portion of the neat gas burner is located behind the first log producing a flicker flame. A portion of the neat gas burner extends to the front of the first log. A pilot is adjacent to the extended portion of the neat gas burner and the primary burner for simultaneously igniting both burners. Preferably the extended portion of the neat gas burner is received in a gap formed by the split between the two members.

11 Claims, 2 Drawing Sheets

ARTIFICIAL LOG ASSEMBLY

BACKGROUND OP THE INVENTION

This invention relates to artificial log assemblies. More particularly, it relates to artificial log assemblies which include both a primary burner and a neat gas burner.

For many centuries, homes have been heated with wood burning fireplaces. The aesthetic appeal of a wood burning fireplace with its warm reddish glow of embers and the flicker of yellow flame is very appealing. However, building and maintaining wood burning fires is time consuming, requires a substantial amount of maintenance, and requires the purchase of properly seasoned wood. In addition, wood burning fire places create a substantial amount of ash which must be disposed of and require an expensive chimney flue which must be cleaned from time to time.

Gas burning fireplaces having artificial logs have become popular in order to avoid some of the problems associated with wood burning fireplaces. However, until recently, gas fired artificial logs have not been nearly as realistic and as aesthetically appealing as wood burning fireplaces. In addition, until recently, gas fired artificial logs all needed a flue or vent similar to a chimney required by a wood burning fireplace.

With the advent of ceramic logs which glow red when exposed to high gas fired temperature, and with the advent of neat gas burners which cause the flames to flicker due to the deprivation of oxygen, gas fired artificial logs have been more popular. Even more recently, their popularity has increased because of the advent of the oxygen depletion sensor which enables one to use a gas fired artificial log assembly in a vent-free application, i.e., without the need for a flue vent or a chimney. This innovation has greatly decreased the cost in the installation of gas fired artificial logs.

A typical gas fired artificial log assembly is described in U.S. Pat. No. 5,069,200. This patent shows an assembly including a primary burner in the front and a neat gas burner in the rear. The primary burner is ignited by a pilot light, however, the neat gas burner is ignited by the hot gases of the primary burner which travel through a tunnel formed in the lower portion of one of the logs.

It is believed that this type of ignition of the neat gas burner from a far removed source presents a possible safety hazard. Furthermore, the artificial log assembly described in this patent is not very realistic.

OBJECTS OF THE INVENTION

It is therefore one object of this invention to provide an improved artificial log assembly.

It is another object to provide an artificial log assembly which is realistic, i.e., closely mimics a wood burning fireplace.

It is still another object to provide a gas fired artificial log assembly which provides for direct and positive ignition of both the primary and neat gas burners.

It is yet another object to provide a gas fired artificial log assembly which is easy to use and is safe.

It is further another object to provide a gas fired artificial log assembly which is aesthetically pleasing.

It is still another object to provide a gas fired artificial log assembly which may be used without a vent.

SUMMARY OF THE INVENTION

In accordance with one form of this invention, there is provided an artificial log assembly which includes a support structure. At least a first artificial log is supported by the support structure. A primary gas burner is located in front of the first artificial log. A neat gas burner is located, in part, behind the first artificial log. The assembly further includes a pilot which is positioned with respect to the primary burner and the neat gas burner for igniting both the primary burner and the neat gas burner.

Preferably, the first artificial log is split into a first log element and a second log element forming a gap therebetween. Also, preferably, a portion of the neat gas burner is located in the gap. In addition, it is preferred that the gap is at an angle greater than 90° with respect to the longitudinal axis of the first artificial log so that the portion of the neat gas burner located in the gap is somewhat hidden from view.

The above-described assembly is very realistic and enables direct ignition of both the primary burner and the neat gas burner by the pilot.

BRIEF DESCRIPTION OF THE DRAWINGS

The subject matter which is regarded as the invention is set forth in the appended claims. The invention itself, however, together with further objects and advantages thereof may be better understood in reference to the following description taken in conjunction with the accompanying drawings in which:

DESCRIPTION OF THE PREFERRED EMBODIMENTS

Figure 1:
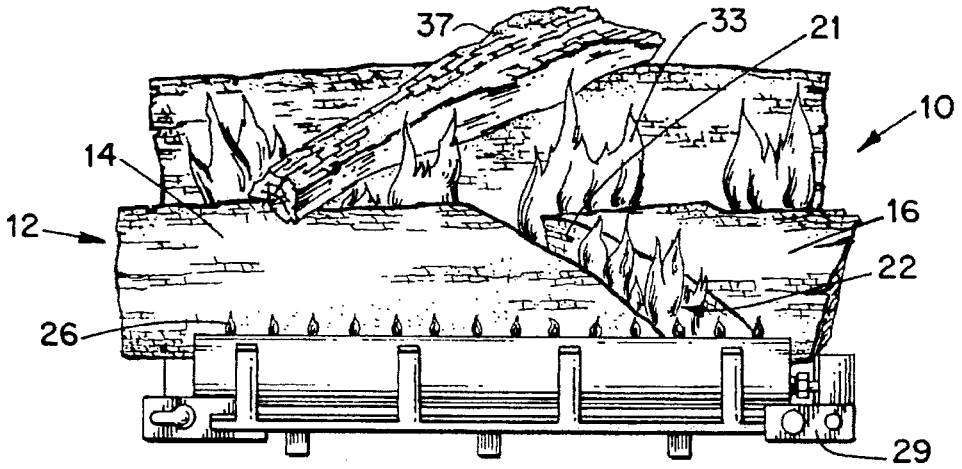
FIG. 1 is a front view of the artificial log assembly showing one embodiment of the subject invention.
Figure 2:
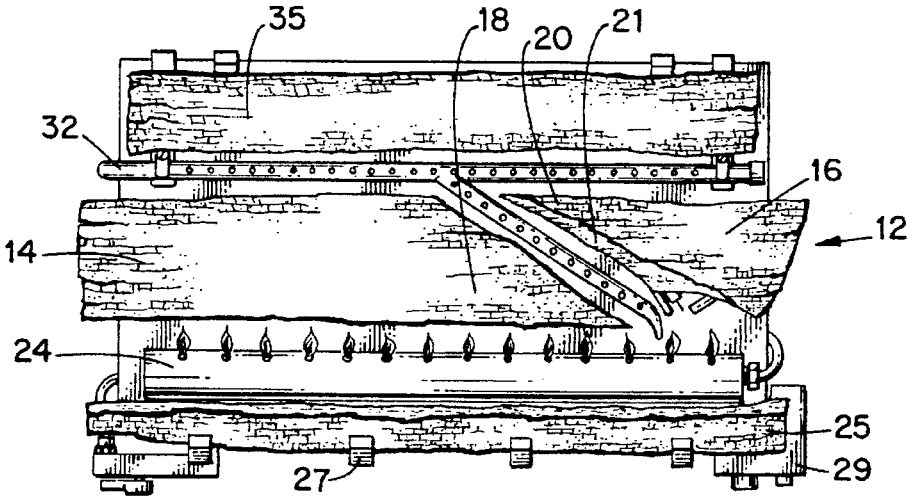
FIG. 2 is a top view of the artificial log assembly of FIG. 1.
Figure 3:
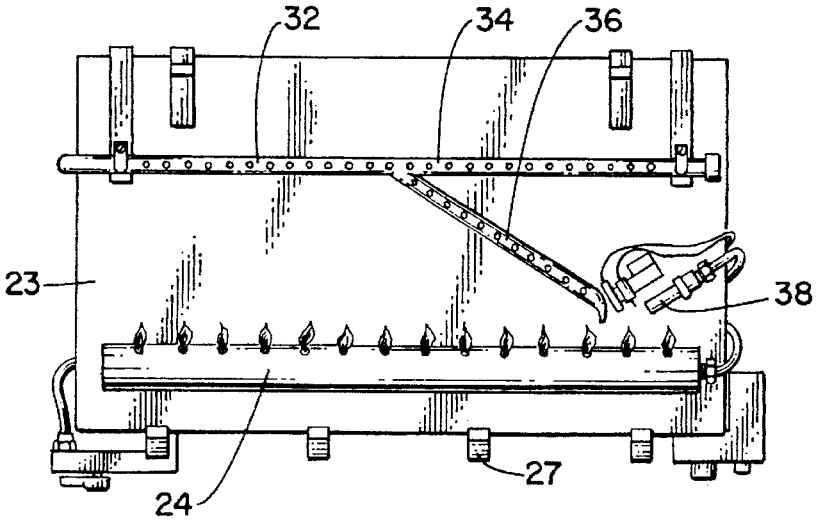
FIG. 3 is a top view of the assembly of FIG. 1, however, with all of the logs having been removed.
Figure 4:
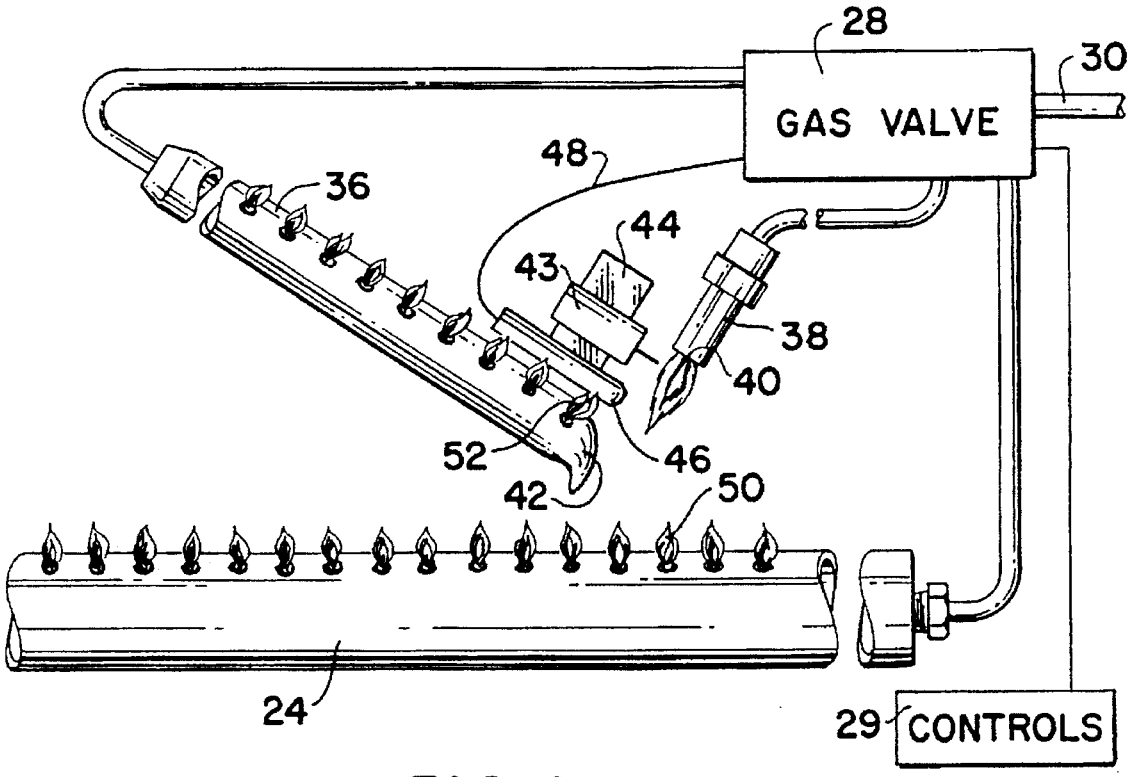
FIG. 4 is a more detailed view of a portion of FIG. 3 and generally showing the relationship among the gas valve, the controls, the pilot and the burners.

Referring now more particularly to FIGS. 1 through 4 which shows the split wood embodiment of Applicants' invention, there is provided artificial gas log assembly 10, which includes a first artificial log 12 which has been split into two log elements 14 and 16. Preferably, artificial log 12, as well as the other artificial logs to be described herein, are made of a fibrous ceramic material which will glow red when exposed to high temperatures. Acceptable artificial logs are commercially available from Refractory Specialties, Inc.

Log element 14 is somewhat larger than log element 16. The juxtaposed ends 18 and 20 of each log element are somewhat wedge shaped. A gap 22 is located between log elements 14 and 16, which provides a realistic split log appearance.

First log 12 rests on support structure 23. Primary burner 24 also rests on support structure 23 and is located in front of first log 12. The primary burner emits hot blue flames 26 toward the front surface of first log 12 so as to cause the first log 12 to glow visibly, giving the appearance of burning embers. The glow will extend into parts of facing 21 of log element 16, including portions of the facing which are located in gap 22 which are near enough to the primary burner to be heated to a glow temperature. The primary burner 24 is connected to gas valve 28 which, in turn, is connected to a gas inlet 30.

Apparatus 10 further includes neat gas burner 32 which also is supported by support structure 23. Neat gas burner 32 burns gas with very little oxygen so as to emit yellow flickering flames 33. The yellow flickering flames add substantial realism to the artificial log assembly.

In the preferred embodiment, the neat gas burner 32 includes two parts with the main portion 34 being located behind first log 12 so that yellow flames will dance from behind and above first log 12. The neat gas burner 32 further includes a branch 36 which extends through gap 22 between the first log element 14 and the second log element 16 to the front of the first log.

Preferably, the gap 22 and the portion 36 of the neat gas burner are at an angle greater than 90° with respect to the longitudinal axis of the first log 12. By providing this angle, the branch portion 36 of the neat gas burner is somewhat hidden from view. In addition, yellow flames from the branch portion 36 of the neat gas burner will appear to dance from the gap 22 extending above both the first element 14 and second element 16. This feature, combined with the split log, adds a great deal of realism to the gas log assembly.

The assembly includes a pilot 38. The flame opening 40 of the pilot is located in close proximity to the distal end 42 of the branch 36 of the neat gas burner 32 and to the primary burner 24. Preferably, the flame opening 40 of the pilot is no further than two inches away from the distal end of branch 36 and from the nearest point on the primary burner 24. By locating the pilot 38 in close proximity to the burner, the pilot is able to ignite both the neat gas burner 32 and the primary burner 24 simultaneously. Thus, the assembly above does not rely on heat provided by the primary burner to ignite the neat gas burner.

In addition, in the embodiments of FIGS. 1–4, by positioning the branch portion 36 of neat gas burner through the gap 22 in log 12, a highly aesthetic and realistic gas log assembly is provided due to the dancing yellow flame which emanates from the gap 22.

The pilot 38 may be ignited by simply lighting a match, or as shown in the embodiments of FIGS. 1–5, the pilot may be ignited by a known sparking apparatus 43 which is mounted to bracket 44. A thermocouple 46 is also mounted to bracket 44 and is electrically connected to the gas valve 28 through wires 48. The thermocouple acts as a safety feature for this assembly so that the gas valve shuts off the gas to the primary burner 24 and the neat gas burner 32 if the pilot is not on.

Initial ignition of the neat gas burner and the primary burner will occur at the holes in the respective burners which are nearest opening 40 of the pilot which is illustrated by flames 50 and 52.

The gas valve 28 and controls 29 and their relationships with the pilot 38 and thermocouple 46 are generally illustrated in this application. More specific illustrations of those assemblies are set forth in U.S. Pat. No. 5,397,233 assigned to Appalachian Stove and Fabricators, Inc., assignee of the present invention, which patent is incorporated herein by reference. The assembly further includes controls 29 which are used to manually turn off and on the gas valve 28. Alternatively, thermostatic controls may be utilized.

Figure 5:
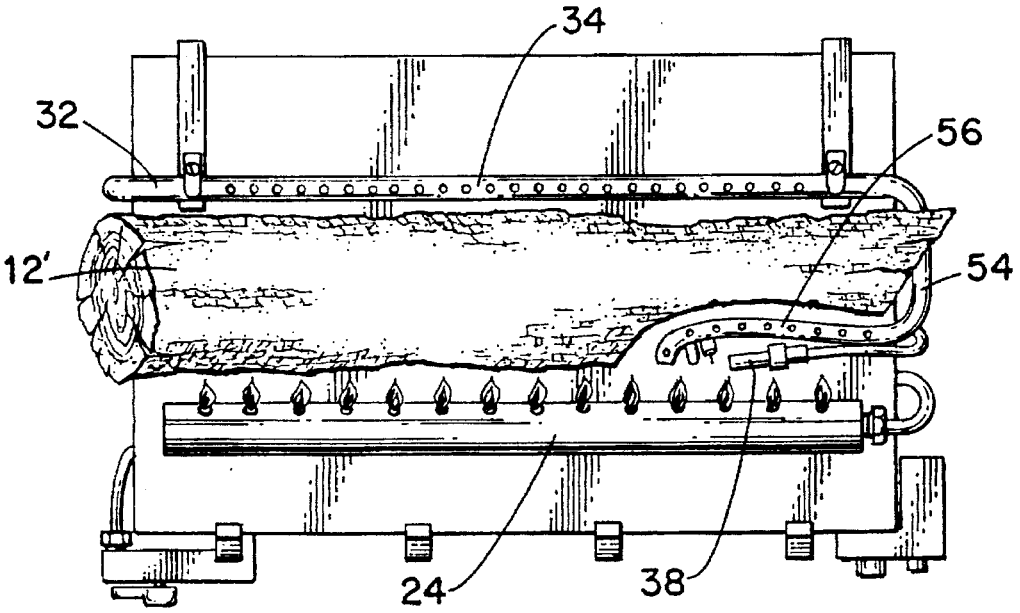
FIG. 5 is a top view of an alternative embodiment of the artificial log assembly of FIG. 1 with some of the logs having been removed.

FIG. 5 shows an alternative embodiment to this invention. The only two differences between the embodiment of FIG. 5 and the embodiment of FIGS. 1–4 are: (a) log 12 which is shown in FIG. 5 is a continuous log, i.e., it is not split into two separate elements, and thus, there is not gap; and (b) neat gas burner 32 does not include a separate branch but is somewhat U-shaped in that portion 54 is curved around and below log 12. Leg 56 of the neat gas burner 32 acts in a similar fashion to branch 36 of the embodiments of FIGS. 1–4 in that portions of branch 56 are located near pilot 38 so that the neat gas burner 32 may be ignited simultaneously with primary burner 24 by the pilot. Portions of first log 12' have been removed so that the relationship between the leg 56 of the neat gas burner, the pilot 38 and primary burner 24 are visible.

The gas assembly of FIGS. 1–5 also includes a second artificial log 25 located in the very front of the assembly to cover, and thus, somewhat hide primary burner 24. Simulated fireplace grate members 27 extend upwardly. Grate members 27 are also connected to support structure 23 and make contact with the second log 25. A third log 35 is located behind portion 34 of neat gas burner 32. The third log is also supported by support structure 23. Also, preferably, a fourth log 37 is laid across the tops of first log 12 and third log 35, again to add realism.

From the foregoing description of the preferred embodiments of the invention, it will be apparent that many modifications may be made therein without departing from the true spirit and scope of the invention. It is to be understood that all such modifications are embodied in the accompanying claims.

What is claimed is:

1. An artificial gas log assembly comprising:

a support structure; at least a first artificial log supported by said support structure; a primary gas burner located in front of said first artificial log;

a neat gas burner; a first portion of said neat gas burner located behind said first artificial log; a second portion of said neat gas burner extending from said first portion to the front of said first artificial log; said first log being split into a first log element and a second log element forming a gap between said first log element and said second log element; said second portion of said neat gas burner located in said gap; said gap being at an angle greater than 90° with respect to the longitudinal axis of said first log; and a pilot; said pilot being positioned with respect to said primary burner and said second portion of said neat gas burner for igniting both said primary burner and said neat gas burner.

2. An artificial gas log assembly comprising:

a support structure; at least a first artificial log supported by said support structure;

a primary gas burner located in front of said first artificial log;

a neat gas burner; said neat gas burner being somewhat U-shaped, thereby forming a first portion located behind said first artificial log and a second portion, parts of which are located in front of said first log; said primary gas burner and said neat gas burner having portions which are substantially physically separated from one another; and a pilot; said pilot being positioned with respect to said primary gas burner and said second portion of said neat gas burner for directly igniting both said primary gas burner and said neat gas burner, without any gas conduits located between said pilot and said neat gas burner or between said pilot and said primary gas burner.

3. An artificial gas log assembly comprising:

a support structure; at least a first artificial log supported by said support structure; a primary gas burner located in front of said first artificial log;

a neat gas burner; at least a first portion of said neat gas burner located behind said first artificial log; said primary gas burner and said neat gas burner having portions which are substantially physically separated from one another; and a pilot; said pilot being positioned with respect to said primary gas burner and said neat gas burner for directly igniting both said primary gas burner and said neat gas burner, without any gas conduits located between said pilot and said neat gas burner or between said pilot and said primary gas burner;

said first log is split into a first log element and a second log element, thereby forming a gap between said first log element and said second log element; a second portion of said neat gas burner located in said gap.

4. An assembly as set forth in claim 3, wherein said gap forms a path between the front and rear of said first log; said second portion of said neat gas burner being located adjacent to said pilot.

5. An assembly as set forth in claim 4, wherein said gap is at an angle greater than 90° with respect to the longitudinal axis of said first log.

6. An assembly as set forth in claim 5, wherein the juxtaposed ends of said first and second log elements are somewhat wedge shaped.

7. An assembly as set forth in claim 4, wherein said primary burner applies sufficient heat to said first log so that a portion of said first log will glow visibly.

8. An assembly as set forth in claim 7, wherein said neat gas burner provides yellow flames in said gap and at the rear of said first log.

9. An assembly as set forth in claim 4, wherein said second portion of said neat gas burner forms a branch from said first portion.

10. An assembly as set forth in claim 9, wherein said second portion of said neat gas burner is connected to said first portion of said neat gas burner near the middle of said first portion of said neat gas burner.

11. An assembly as set forth in claim 3, wherein said neat gas burner extends along the rear of said first log, around and under one end of said first log to the front of said first log adjacent to said pilot and to said primary burner.

* * * * *